US005859616A

United States Patent [19]

Gans et al.

[11] Patent Number: 5,859,616

[45] Date of Patent: Jan. 12, 1999

[54] INTERLEAVED PLANAR ARRAY ANTENNA SYSTEM PROVIDING ANGULARLY ADJUSTABLE LINEAR POLARIZATION

[75] Inventors: Lawrence S. Gans, Sparta; Leonard Schwartz, Montville, both of N.J.

[73] Assignee: GEC-Marconi Hazeltine Corporation, Wayne, N.J.

[21] Appl. No.: 833,840

[22] Filed: Apr. 10, 1997

[51] Int. Cl.[6] ..... H01Q 1/38

[52] U.S. Cl. ..... 343/700 MS; 343/846; 343/754; 343/854; 343/767; 342/375; 342/371; 342/368

[58] Field of Search ..... 343/700 MS, 846, 343/727, 829, 815, 797, 853; 342/375, 368, 371, 770

[56] References Cited

U.S. PATENT DOCUMENTS

| | | | |
|---|---|---|---|
| 3,886,547 | 5/1975 | Bottenberg | 343/100 SA |
| 4,054,874 | 10/1977 | Oltman | 343/700 MS |
| 4,131,896 | 12/1978 | Miller | 343/815 |
| 4,170,012 | 10/1979 | Kaloi | 343/700 |
| 4,740,793 | 4/1988 | Wolfson et al. | 343/700 MS |
| 5,400,042 | 3/1995 | Tulintseff | 343/727 |
| 5,512,906 | 4/1996 | Speciale | 342/375 |

OTHER PUBLICATIONS

"Analysis and Design Series–Fed Arrays of Printed–Dipoles Proximity–Coupled to a Perpendicular Microstripline", N.K. Das and D.M. Pozar, IEEE Transactions on Antennas and Propagation, vol. 37, No. 4, pp. 435–444.

*Primary Examiner*—Frank G. Font
*Assistant Examiner*—Layla G. Lauchman
*Attorney, Agent, or Firm*—David L. Davis

[57] ABSTRACT

An interleaved planar array antenna system providing angularly adjustable linearly polarized beams comprises an array of parallel rows of transmit dipole element pairs and an array of parallel rows of receive dipole element pairs, the two arrays being interleaved. Each of the dipole element pairs includes a first dipole element and a second dipole element adjacent and orthogonal to the first dipole element. All of the first dipole elements are parallel to each other and all of the second dipole elements are parallel to each other. All of the dipole elements are on the same surface and on another surface parallel to and spaced from the first surface there is an array of transmit feed line pairs and an array of receive feed line pairs, with the arrays being interleaved with each other. The transmit feed line pairs are proximity coupled to the transmit dipole element pairs and the receive feed line pairs are proximity coupled to the receive dipole element pairs. By controlling the relative amplitudes and phases of signals applied to the two feed lines within each feed line pair, the resultant angle of linear polarization of a composite signal from the respective dipole element pairs is adjustable.

16 Claims, 5 Drawing Sheets

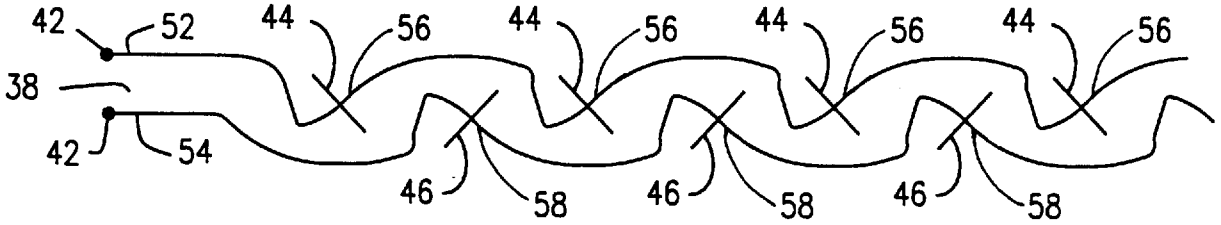
FIG. 4
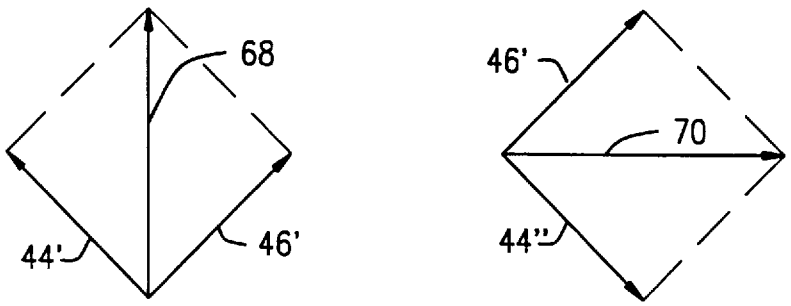
FIG. 5
FIG. 6
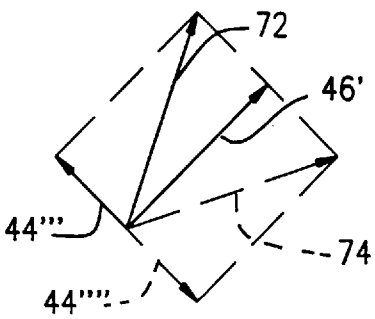
FIG. 7

INTERLEAVED PLANAR ARRAY ANTENNA SYSTEM PROVIDING ANGULARLY ADJUSTABLE LINEAR POLARIZATION

BACKGROUND OF THE INVENTION

This invention relates to planar antenna systems and, more particularly, to such a system for providing angularly adjustable linearly polarized beams.

Antennas for use in satellite communications systems are generally required to operate over two frequency bands—one for the uplink (i.e., transmitting to the satellite) and the other for the downlink (i.e., receiving from the satellite). Further, the uplink (or transmit) and downlink (or receive) beams have different polarizations. Any antenna used for satellite communications must incorporate these features, in addition to providing adequate signal strength and the proper radiation pattern (beamwidth, sidelobes, etc.) for distinguishing between satellites. It is therefore an object of the present invention to incorporate both uplink and downlink features in a single, low cost, lightweight, antenna.

In a particular application, the transmit and receive beams have orthogonally directed linear polarizations. It is therefore another object of this invention to provide an antenna which accommodates such polarizations.

In this application, the polarization vectors of the satellite antenna and the satellite communications system antenna are each oriented in a respective single direction for the uplink and for the downlink and must coincide at all times in order for the two to communicate effectively. The apparent orientation of the satellite antenna's polarization will depend on its position relative to the satellite communications system antenna. If the latter antenna is required to communicate with a number of satellites in different locations, its polarization must be adjustable. In this particular context, adjustable means rotatable about an axis orthogonal to the linear polarization vector. In addition, the uplink and downlink polarizations must be kept orthogonal, which implies that both must be rotatable. Further, if the satellite communications system antenna is mounted to a moving body, such as an aircraft, its polarization must be rotatable on a real-time basis to take account of the changing position of the antenna. It is therefore a further object of this invention to provide a linearly polarized antenna wherein the direction of polarization is rotatable (i.e., angularly adjustable) on a real-time basis.

SUMMARY OF THE INVENTION

The foregoing and additional objects are attained in accordance with the principles of this invention by providing an antenna system comprising first and second dipole elements on a first dielectric surface, with the second dipole element being adjacent and at an angle to the first dipole element. A pair of feed lines are provided on a second dielectric surface which is parallel to and spaced from the first surface. A first of the pair of feed lines is proximity coupled to the first dipole element and a second of the pair of feed lines is proximity coupled to the second dipole element. Control means are provided for controlling the relative amplitudes and phases of signals applied to the first and second of the pair of feed lines so as to control the resultant angle of linear polarization of a composite signal from the first and second dipole elements.

In accordance with an aspect of this invention, the first feed line is orthogonal to the first dipole element at the location where it is proximity coupled, and the second feed line is orthogonal to the second dipole element at the location where it is proximity coupled.

In accordance with another aspect of this invention, the first and second dipole elements are orthogonal to each other.

BRIEF DESCRIPTION OF THE DRAWINGS

The foregoing will be more readily apparent upon reading the following description in conjunction with the drawings in which like elements in different figures thereof are identified by the same reference numeral and wherein:

FIG. 4 illustrates the feeding of the dipole elements by the feed lines in the antenna system of FIG. 1;

FIGS. 5–7 schematically illustrate resultant linear polarizations achieved by controlling the feed amplitudes and phases;

DETAILED DESCRIPTION

Figure 1:
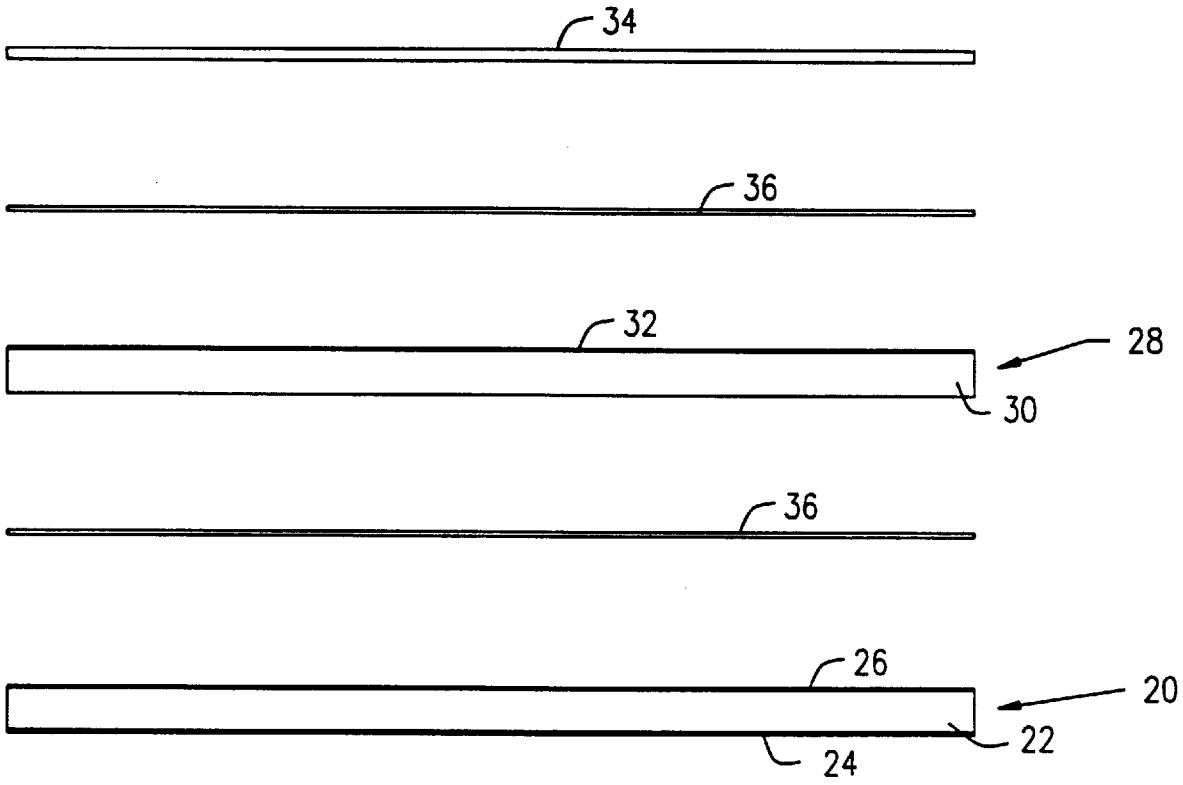
FIG. 1 is an exploded side view identifying the different layers of an illustrative embodiment of an antenna system constructed in accordance with the principles of this invention.

Referring now to the drawings, the inventive antenna is constructed of multiple layers of copper-clad, Teflon-based, temperature-stable dielectric sheet material. The antenna feed lines and radiating elements and the polarizer grid lines are all etched from the copper-clad material. The layers are stacked and bonded together by means of a film adhesive. FIG. 1 shows the layers for the inventive antenna. The first layer 20 includes a dielectric laminate substrate 22 having copper cladding on both its major surfaces. On the lower surface, the copper cladding 24 remains intact as a ground plane for the antenna, whereas on the upper surface the copper cladding is etched to provide feed lines 26 for the antenna's radiating elements. The second layer 28 includes a dielectric laminate substrate 30 which has copper cladding only on its upper surface, this copper cladding being etched to form the radiating elements 32 of the antenna. The third layer 34 comprises an uncladded dielectric laminate cover for the antenna. Between each of the superposed aforedescribed layers is a respective adhesive bonding film 36. To fabricate the aforedescribed antenna, the copper cladding on the dielectric laminates is etched to form the antenna feed lines 26 and the radiating elements 32, then a "sandwich" is made of all the layers with the bonding film 36 interposed between adjacent layers. The sandwich is then laminated in a heated press, removed from the press and machined to its final configuration. In an illustrative embodiment, the overall finished size of the antenna is approximately eighteen inches wide by eighteen inches long by 0.10 inches thick.

Figure 2:
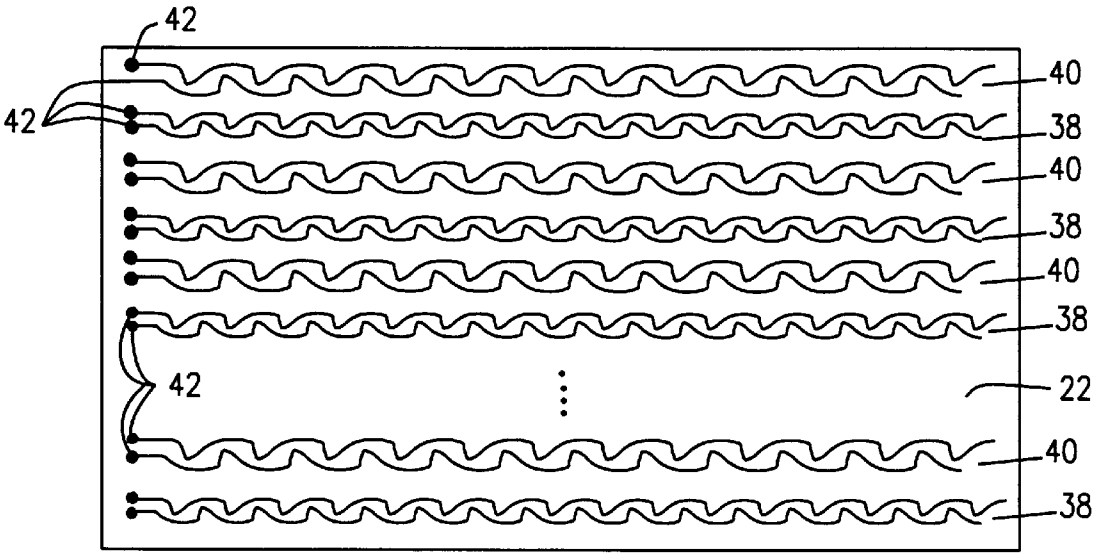
FIG. 2 shows the feed lines of the antenna system of FIG. 1.

FIG. 2 illustrates the feed lines 26 on the substrate 22. As shown, there are transmit feed line pairs 38 and receive feed line pairs 40, each of which extends generally along a respective one of a plurality of parallel straight lines, with the transmit feed line pairs 38 and the receive feed line pairs 40 being interleaved and alternating with each other. Each of the feed lines in the feed line pairs 38, 40 has undulations to provide a plurality of parallel evenly spaced straight segments each at an angle of ±45° to the straight lines (which extend horizontally as viewed in FIG. 2). As will be described in full detail hereinafter, the segments of the first feed line in each of the feed line pairs are orthogonal to the segments of the other feed line in each of the feed line pairs. Along one edge of the substrate 22, each of the feed lines of the feed line pairs 38, 40 is terminated by a respective circular pad 42. The pads 42 are for attachment to respective coaxial connectors (not shown) which are in turn attached to a power distribution network, illustratively of the type shown in FIG. 8, which will be described in full detail hereinafter. According to the present invention, the pads 42 for both the transmit feed line pairs 38 and the receive feed line pairs 40 are at the same end of the antenna system. By having all of the feed lines fed from the same end of the antenna, both the transmit and receive beams will move in the same direction as the transmit and receive frequencies change in the same direction.

Figure 3:
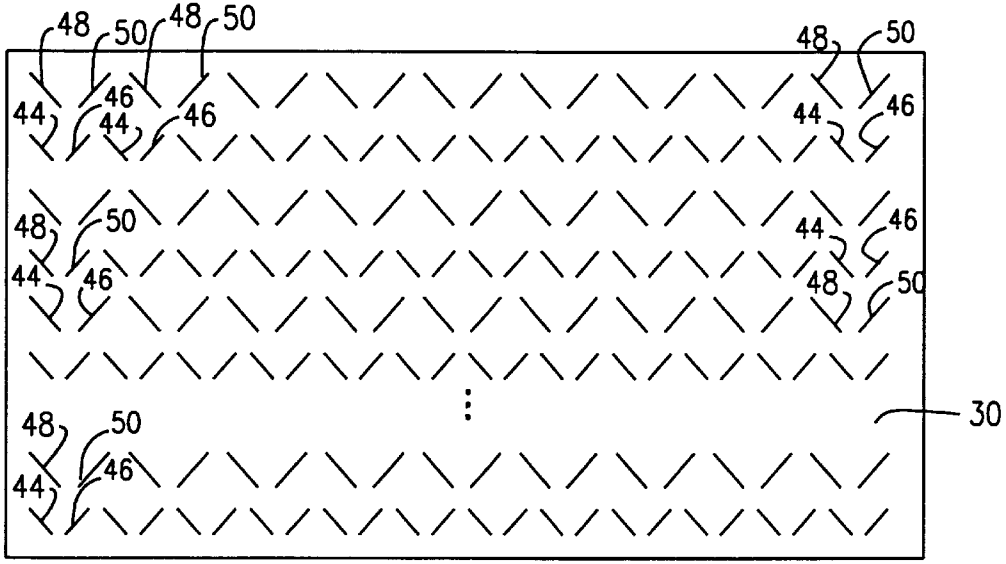
FIG. 3 shows the transmit and receive dipole elements of the antenna system of FIG. 1.

FIG. 3 illustrates the dipole radiating elements 32 on the substrate 30. The radiating elements 32 comprise straight line segments, each being oriented at an angle of ±45° from the horizontal (as viewed in FIG. 3). The transmit radiating elements are provided in the form of a plurality of dipole element pairs arranged in linear arrays. Each of the transmit pairs includes a first dipole element 44 and a second dipole element 46 adjacent and at an angle to the first dipole element 44. The first dipole elements 44 are parallel to each other and the second dipole elements 46 are parallel to each other. Preferably, the first dipole elements 44 are orthogonal to the second dipole elements 46. Similarly, the receive radiating elements are provided in the form of a plurality of dipole element pairs arranged in linear arrays. Each of the receive pairs includes a first dipole element 48 and a second dipole element 50 adjacent and at an angle to the first dipole element 48. The first dipole elements 48 are parallel to each other and the second dipole elements 50 are parallel to each other. Preferably, the first dipole elements 48 are orthogonal to the second dipole elements 50. Also preferably, the first transmit dipole elements 44 are parallel to the first receive dipole elements 48 and the second transmit dipole elements 46 are parallel to the second receive dipole elements 50. As will become clear from the following discussion, the transmit dipole element pairs 44, 46 overlie respective transmit line pairs 38 and the receive dipole element pairs 48, 50 overlie respective receive feed line pairs 40.

The length of each of the transmit dipole elements 44, 46 is nominally one-half the effective wavelength in the dielectric 30 at the center frequency of the transmit frequency band. Similarly, the length of each of the receive dipole elements 48, 50 is nominally one-half the effective wavelength in the dielectric 30 at the center frequency of the receive frequency band. This optimizes the gain of the antenna. Further, the transmit dipole elements 44 within each linear array lie along a respective straight line and are spaced closer than one wavelength of the highest frequency of the transmit frequency band. The same applies for the transmit dipole elements 46, which are interleaved with the elements 44 within each linear array. Similarly, the receive dipole elements 48 within each linear array lie along a respective straight line and are spaced closer than one wavelength of the highest frequency of the receive frequency band. The same applies for the receive dipole elements 50, which are interleaved with the elements 48 within each linear array. This spacing results in the provision of travelling wave arrays from the antenna.

FIG. 4 illustrates the feeding of the transmit dipole elements 44, 46 by the feed line pair 38, which includes the feed line 52 and the feed line 54, each connected to a respective circular pad 42. When viewing FIG. 4, it is understood that the transmit dipole elements 44, 46 are actually on the substrate 30 and the feed lines 52, 54 are actually on the underlying substrate 22. In any event, the feed lines 52, 54 have undulations so that the feed line 52 has a plurality of parallel evenly spaced straight segments 56 each underlying a respective transmit dipole element 44 and being orthogonal thereto to provide proximity coupling, as will be described in full detail hereinafter. Similarly, the transmit feed line 54 has undulations so that it includes a plurality of parallel evenly spaced straight segments 58 each underlying a respective transmit dipole element 46 and being orthogonal thereto to provide proximity coupling. The receive feed line pairs 40 are similarly constructed as two feed lines 60, 62 (FIG. 12) with respective straight line segments 64, 66 associated with the receive dipole elements 48, 50.

Since the two sets of alternating elements 44, 46 in each linear array of transmit radiating dipole elements are fed by separate feed lines 52, 54, the amplitude and phase of each set can be independently controlled so as to control the resultant angle of linear polarization of a composite signal from the two sets. Thus, the two sets of elements generate orthogonal linearly polarized signals and the resultant linear polarization is a vector combination of the two. The direction of the resultant polarization is determined by the relative amplitudes and phases of the two sets of signals, and can be changed by simply changing those relative amplitudes and/or phases, by controlling the amplitudes and phases of the two feeds.

As schematically illustrated in FIG. 5, the arrow labeled 44' is a vector representation of the linearly polarized signal from the element 44 and the arrow labeled 46' is a representation of the linearly polarized signal from the element 46, where the feed signals applied to the elements 44 and 46 have equal amplitude and zero phase shift. The resultant polarization of the composite signal is vertical, as indicated by the arrow 68. As shown in FIG. 6, by feeding the element 44 with the same amplitude as element 46 but with opposite (i.e., 180°) phase, as indicated by the arrow 44", the resultant polarization 70 is changed to horizontal. The general situation is illustrated in FIG. 7, where it is seen that the polarization 44'" obtained by feeding element 44 at the same phase as the element 46 but with attenuation, the resultant polarization 72 at an angle between vertical and horizontal is obtained. Similarly, by reversing the phase of the signal applied to the element 44 to obtain the polarization shown by the arrow 44"", the resultant polarization 74 is obtained. Thus, by providing a two-state phase control to the feed lines 52, 54 and by selectively attenuating the feed signals, a desired angle of linear polarization is effected. It is noted that properly controlled delays to the signals applied to the pads 42 will insure that the elements within each element pair are fed at the same time.

Figure 8:
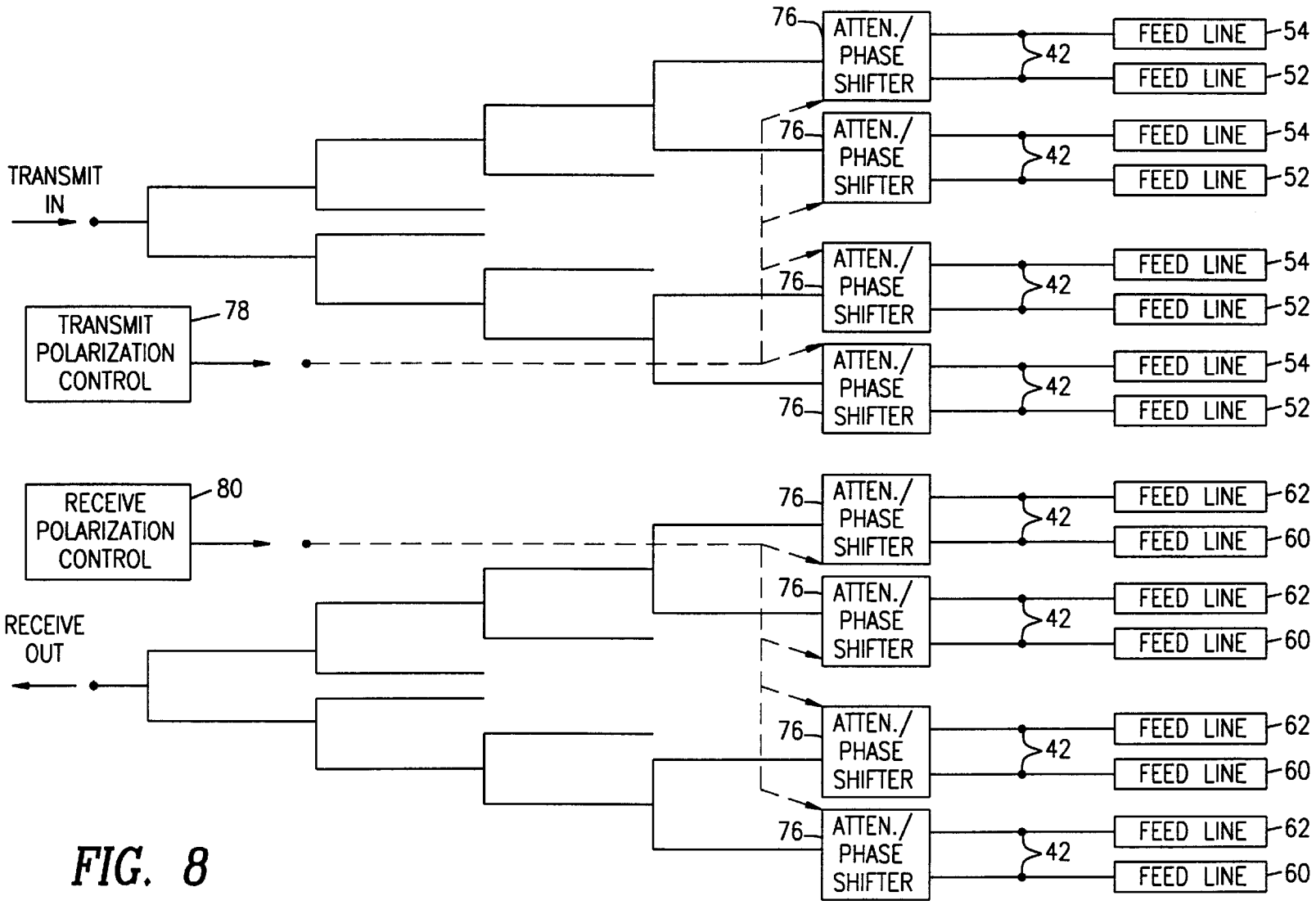
FIG. 8 illustrates a feed power distribution network with amplitude/phase control for the antenna system of FIG. 1.

FIG. 8 illustrates a feed power distribution network with amplitude/phase control for the inventive antenna system in order to control the angle of linear polarization. As shown, control of the amplitudes and phases of the feed signals is effected by a plurality of attenuators/phase shifters 76 interposed between a conventional corporate feed and the pads 42. Each of the devices 76 includes a controllable signal attenuator and a two-state (i.e., 0° and 180°) phase shifter. The signals to the transmit feed lines 52, 54 are controlled by the transmit polarization control 78 and the signals to the receive feed lines 60, 62 are controlled by the receive polarization control 80. The polarization controls 78, 80 function to effect a desired angle of linear polarization, as discussed above with respect to FIGS. 5–7, as well as to maintain the required orthogonal relationship between the transmit and receive polarizations.

Figure 10:
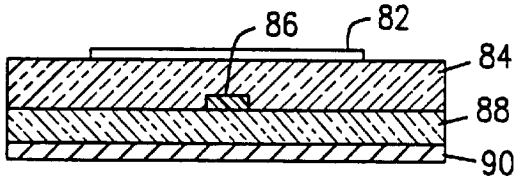
FIG. 10 is a cross sectional view taken along the line 10—10 of FIG. 9.
Figure 9:
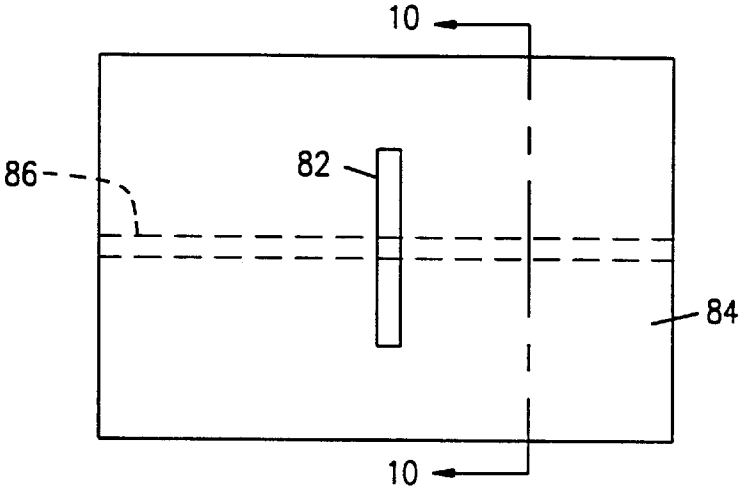
FIG. 9 is a top view generally illustrating proximity coupling of a feed line and a dipole element.
Figure 11:
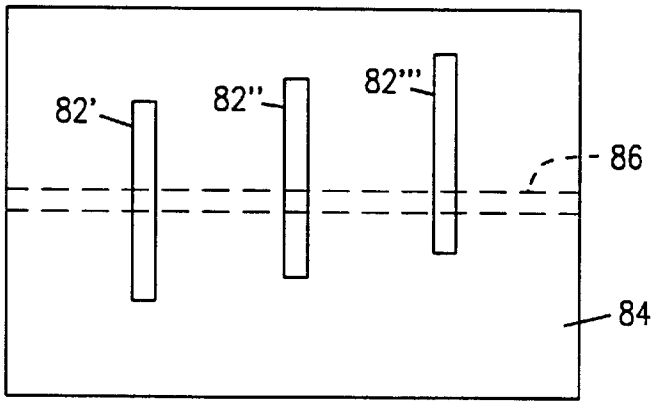
FIG. 11 is a view similar to FIG. 9 showing how to vary the coupling between the feed line and the dipole element.

The antenna on the substrates 22 and 30 operates on the principle of proximity coupling where energy is coupled to the radiating elements from the feed lines by virtue of the close proximity to each other without requiring any direct connection between the feed lines and the radiating elements. FIGS. 9 and 10 illustrate the basic physical configuration for proximity coupling wherein a printed dipole element 82 is printed on a substrate 84 and a feed line 86 is printed on a substrate 88 immediately sub-adjacent to the substrate 84, with a ground plane 90 provided on the lower surface of the substrate 88. The amount of energy coupled between the feed line 86 and the dipole element 82 depends on the amount of offset between the element 82 and the feed line 86. As shown in FIG. 11, the least amount of coupling is provided to the element 82, which is centered over the feed line 86. Maximum coupling is provided to the element 82''' which is almost completely offset from the feed line 86, and an intermediate amount of coupling is provided to the element 82'' which is positioned between the position of the element 82, and the position of the element 82'''. A complete description of the proximity coupled principle is found in the article "Analysis and Design of Series-Fed Arrays of Printed-Dipoles Proximity-Coupled to a Perpendicular Microstripline", N. K. Das and D. M. Pozar, IEEE Transactions on Antennas and Propagation, Volume 37, No. 4, April 1989, pages 435–444, the contents of which are incorporated by reference herein.

As previously described, the sets of interleaved transmit elements 44, 46 are located directly over straight segments of the transmit feed lines 52, 54, respectively. The elements 44, 46 are oriented at angles of −45° and +45°, respectively, to the vertical, giving the result that the two sets of elements are orthogonal to each other. This is done in order to generate two orthogonally polarized linear signals from the elements 44, 46 which are then combined into a composite angularly adjustable linearly polarized signal, as described above.

Figure 12:
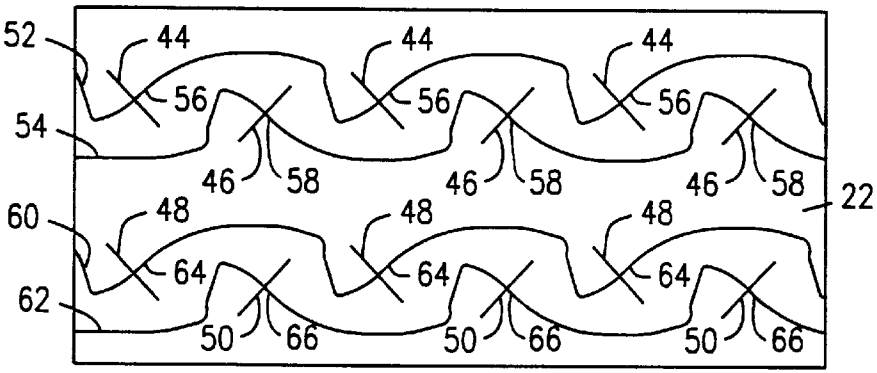
FIG. 12 illustrates the coupling of transmit and receive arrays of dipole element pairs with feed line pairs according to this invention.

As shown in FIG. 12, the feed lines 52, 54 have undulations so that at the locations where the radiating dipole elements 44, 46 cross the respective feed lines 52, 54, the feed lines have straight segments 56, 58, respectively, which are orthogonal to the elements 44, 46. Thus, the straight segments 56, 58 are orthogonal to each other. The amount of offset between the elements 44, 46 and the respective feed line segments 56, 58 determines the degree of coupling therebetween. Since the offset between the feed lines and the radiating elements controls the amount of coupling (FIG. 11), this effect is utilized to control the radiation pattern to reduce sidelobes in order to meet sidelobe requirements of the antenna. Similar comments apply to the receive dipole elements 48, 50 and the respective receive feed lines 60, 62 and their straight segments 64, 66.

In the illustrative embodiment, the transmission frequency band is from 14.0 to 14.5 GHz and the receive frequency band is from 11.0 to 11.5 GHz. Therefore, the transmit and receive radiating elements and feed lines are designed to operate in their respective frequency bands. As is well known, the physical size of each element determines its frequency of operation, with a higher frequency of operation resulting in smaller dimensions. The length of each dipole element is nominally one-half the effective wavelength in the dielectric at the center frequency of its respective frequency band. The spacing between the correspondingly angled radiating elements in each row is less than one wavelength, resulting in travelling-wave arrays. The pointing angles of the beams generated by the transmit and receive arrays will therefore move in the azimuth direction as the frequency changes. Since both the transmit and receive feed line pairs 38, 40 are fed from the same end, this movement will be in the same direction as the transmit and receive frequencies change in the same direction. The actual element spacing for the two sets of arrays are chosen so that the transmit and receive beams are at the same pointing angle at the centers of the two different 500 MHz frequency bands. As the frequency changes up or down, the pointing angles will change, but the two beams will remain approximately coincident (to within about 0.1° for a 3° to 4° beamwidth) as long as the transmit and receive frequencies are at approximately the same position in their respective bands.

An advantage of the aforedescribed antenna is that two frequencies of operation and two electronically rotatable orthogonal linear polarizations are produced from a single layer of printed linear dipole elements. This is made possible by orienting the pairs of transmit and receive radiating elements orthogonal to each other. The simple one-line feeding arrangement (i.e., series feeding—where energy goes in one end and is distributed to the radiating elements one after another) occupies a minimal amount of aperture real estate, allowing the interleaving of the two sets of radiating arrays.

Accordingly, there has been disclosed an improved interleaved planar array antenna system providing angularly adjustable linearly polarized beams. Although printed circuit elements have been disclosed herein, one of ordinary skill in the art will appreciate that an equivalent configuration using slots can also be constructed. Also, while in the illustrative embodiment the transmit and receive antenna arrays have been described as producing orthogonal linear polarizations, it is to be understood that the polarizations of the two antenna arrays are independently adjustable and are not necessarily orthogonally related. Therefore, while an illustrative embodiment of the present invention has been disclosed, it is understood that various modifications and adaptations to the disclosed embodiment will be apparent to those of ordinary skill in the art and it is intended that this invention be limited only by the scope of the appended claims.

What is claimed is:

1. An antenna system comprising:

a first dipole element on a first dielectric surface;

a second dipole element on said first surface, the second dipole element being adjacent and at an angle to the first dipole element;

a pair of feed lines on a second dielectric surface parallel to and spaced from said first surface, a first of said pair of feed lines being proximity coupled to said first dipole element and a second of said pair of feed lines being proximity coupled to said second dipole element; and control means for controlling the relative amplitudes and phases of signals applied to said first and second of said pair of feed lines so as to control the resultant angle of linear polarization of a composite signal from said first and second dipole elements.

2. The antenna system according to claim 1 wherein:

said first feed line is orthogonal to said first dipole element at the location where it is proximity coupled; and said second feed line is orthogonal to said second dipole element at the location where it is proximity coupled.

3. The antenna system according to claim 1 wherein said first and second dipole elements are orthogonal to each other.

4. An antenna system comprising:

a first planar dielectric substrate;

a plurality of dipole element pairs arranged in a linear array on a first surface of said first substrate, with each of said pairs including a first dipole element and a second dipole element adjacent and at an angle to said first dipole element, and wherein said first dipole elements are parallel to each other and said second dipole elements are parallel to each other;

a second planar dielectric substrate underlying and parallel to said first substrate on the side of said first substrate opposite said first surface; and a pair of feed lines on the surface of said second substrate which is adjacent said first substrate, a first of said pair of feed lines being proximity coupled to said first dipole elements of said plurality of dipole element pairs and a second of said pair of feed lines being proximity coupled to said second dipole elements of said plurality of dipole element pairs.

5. The antenna system according to claim 4 wherein said linear array of dipole element pairs and said pair of feed lines are duplicated, with one such set being used as a receive antenna and the other such set being used as a transmit antenna, and with the linear arrays making up the receive and transmit antennas being parallel to each other.

6. The antenna system according to claim 5 wherein there are a plurality of receive antenna arrays and a plurality of transmit antenna arrays which are interleaved and alternating with each other.

7. The antenna system according to claim 5 wherein the antenna system is adapted for use in a communications system operating over separate transmit and receive frequency bands and wherein:

the length of each transmit dipole element is nominally one-half the effective wavelength in the dielectric at the center frequency of the transmit frequency band; and the length of each receive dipole element is nominally one-half the effective wavelength in the dielectric at the center frequency of the receive frequency band.

8. The antenna system according to claim 7 wherein:

the transmit dipole elements associated with each of the pair of transmit feed lines lie along a respective straight line and are spaced closer than one wavelength of the highest frequency of the transmit frequency band; and the receive dipole elements associated with each of the pair of receive feed lines lie along a respective straight line and are spaced closer than one wavelength of the highest frequency of the receive frequency band;

whereby travelling wave arrays are provided.

9. The antenna system according to claim 4 further including:

control means for controlling the relative amplitudes and phases of signals applied to said first and second of said pair of feed lines so as to control the resultant angle of linear polarization of a composite signal from said dipole element pairs.

10. The antenna system according to claim 9 wherein each of said first dipole elements is orthogonal to each of said second dipole elements.

11. A planar printed circuit antenna system for use in a communications system wherein the antenna transmit and receive signals operate over at least one frequency band and are linearly polarized, the antenna system comprising:

a first planar dielectric substrate;

a plurality of transmit feed line pairs on a first surface of said first substrate and extending generally along a first plurality of parallel straight lines, said plurality of transmit feed line pairs having undulations so that each of said transmit feed lines includes a plurality of parallel evenly spaced straight segments each at an angle of forty-five degrees to said first plurality of straight lines, wherein the segments of a first of each of said transmit feed line pairs is orthogonal to and interleaved with the segments of the second of said each of said transmit feed line pairs, and wherein all of the segments of each of said transmit feed line pairs lie along a respective one of said first plurality of straight lines;

a plurality of receive feed line pairs on said first surface of said first substrate and extending generally along a second plurality of parallel straight lines interleaved with and parallel to said first plurality of straight lines, said plurality of receive feed line pairs having undulations so that each of said receive feed lines includes a plurality of parallel evenly spaced straight segments each at an angle of forty-five degrees to said second plurality of straight lines, wherein the segments of a first of each of said receive feed line pairs is orthogonal to and interleaved with the segments of the second of said each of said receive feed line pairs, and wherein all of the segments of each of said receive feed line pairs lie along a respective one of second plurality of straight lines;

a second planar dielectric substrate overlying and parallel to said first surface of said first substrate;

a plurality of transmit radiating elements on the surface of said second substrate which is opposite said first substrate, said transmit radiating elements comprising straight line segments each overlying and orthogonal to a respective one of said transmit feed line parallel evenly spaced segments; and a plurality of receive radiating elements on said second substrate opposite surface and comprising straight line segments each overlying and orthogonal to a respective one of said receive feed line parallel evenly spaced segments.

12. The antenna system according to claim 11 wherein the spacing between the segments in each of the transmit feed lines is less than one wavelength of the highest frequency of the transmit frequency band and the spacing between the segments in each of the receive feed lines is less than one wavelength of the highest frequency of the receive frequency band.

13. The antenna system according to claim 11 wherein the length of each of said transmit radiating element straight line segments is nominally one-half the effective wavelength in the dielectric at the center frequency of the transmit frequency band and the length of each of said receive radiating element straight line segments is nominally one-half the effective wavelength in the dielectric at the center frequency of the receive frequency band.

14. The antenna system according to claim 11 wherein the spacing between radiating elements associated with respective feed lines is less than one wavelength of the highest frequency of the respective frequency band, whereby travelling wave arrays are provided.

15. The antenna system according to claim 11 wherein all of said feed lines are fed from the same end of the antenna system, whereby both the transmit and receive beams move in the same direction as the transmit and receive frequencies change in the same direction.

16. The antenna system according to claim 11 further including:

transmit control means for controlling the relative amplitudes and phases of signals applied to said transmit feed line pairs so as to control the resultant angle of linear polarization of a composite signal radiated by said transmit radiating elements; and receive control means for controlling the relative amplitudes and phases of signals taken from said receive feed line pairs so as to control the resultant angle of linear polarization of a composite signal received by said receive radiating elements.

* * * * *